US011390990B2

(12) United States Patent
Jiang et al.

(10) Patent No.: US 11,390,990 B2
(45) Date of Patent: Jul. 19, 2022

(54) PHENOLS AS ADDITIVES IN KRAFT PULPING

(71) Applicant: Auburn University, Auburn, AL (US)

(72) Inventors: Zhihua Jiang, Auburn, AL (US); Burak Aksoy, Auburn, AL (US)

(73) Assignee: Auburn University, Auburn, AL (US)

( * ) Notice: Subject to any disclaimer, the term of this patent is extended or adjusted under 35 U.S.C. 154(b) by 56 days.

(21) Appl. No.: 16/162,553

(22) Filed: Oct. 17, 2018

(65) Prior Publication Data

US 2019/0112757 A1 Apr. 18, 2019

Related U.S. Application Data

(60) Provisional application No. 62/573,510, filed on Oct. 17, 2017.

(51) Int. Cl.

| | |
|---|---|
| ***D21C 3/00*** | (2006.01) |
| ***D21C 3/22*** | (2006.01) |
| ***D21C 3/02*** | (2006.01) |
| ***D21H 11/04*** | (2006.01) |

(52) U.S. Cl.

CPC ..... *D21C 3/003* (2013.01); *D21C 3/02* (2013.01); *D21C 3/222* (2013.01); *D21H 11/04* (2013.01)

(58) Field of Classification Search

CPC ..... D21C 3/222
USPC ..... 162/77
See application file for complete search history.

(56) References Cited

U.S. PATENT DOCUMENTS

| | | | | |
|---|---|---|---|---|
| 296,935 | A | 4/1884 | Dahl | |
| 2,070,632 | A | 2/1937 | Tomlinson | |
| 2,783,146 | A | 2/1957 | McKee | |
| 3,446,700 | A * | 5/1969 | Hall | D21C 3/222 162/72 |
| 4,134,787 | A | 1/1979 | Eckert | |
| 4,208,350 | A * | 6/1980 | Hearon | C07C 37/005 568/324 |
| 4,213,821 | A | 7/1980 | Farrington et al. | |
| 4,597,830 | A | 1/1986 | April et al. | |
| 5,250,152 | A | 10/1993 | Ling et al. | |
| 6,770,168 | B1 | 8/2004 | Stigsson | |
| 2004/0089431 | A1 * | 5/2004 | Fant | D21C 1/06 162/29 |
| 2007/0240837 | A1 * | 10/2007 | Shin | D21C 3/02 162/76 |

FOREIGN PATENT DOCUMENTS

| | | | |
|---|---|---|---|
| EP | 0 957 198 | A1 | 11/1999 |
| JP | S5240604 | A | 3/1977 |
| JP | S5692233 | A | 7/1981 |
| WO | WO 00/47812 | A | 8/2000 |

OTHER PUBLICATIONS

Lowendahl et al., Phenolic compounds in kraft black liquor, 1978, Svensk papperstidning, no, Dec. 1978, p. 392-396 (Year: 1978).*

(Continued)

*Primary Examiner* — Anthony Calandra
(74) *Attorney, Agent, or Firm* — Christopher M. Scherer; DeWitt LLP

(57) ABSTRACT

Described is a method of kraft pulping in which a phenolic compound is added to the cooking step. The phenolic compound is added at a time point between about 5 minutes and about 120 minutes prior to completion of the cooking step. The presence of the phenolic compound increases the extent of delignification in the cooking step.

4 Claims, 2 Drawing Sheets

(56) References Cited

OTHER PUBLICATIONS

Ragnar Sjodahl, Some aspects on the Effects of Dissolved Wood Components in Kraft Pulping, 2006, Royal Institute of Technology (Year: 2006).*
Smook, Handbook for Pulp and Paper Technologists, 1992, Angus Wilde Publications, 2nd edition, chapters 9 and 26. (Year: 1992).*
Majtnerová et al., Radical coupling—A major obstacle to delignification in kraft pulping, 2006, Nordic Pulp and Paper Research Journal vol. 21 No. 1 (Year: 2006).*
Gellerstedt et al., Towards a new concept of lignin condensation in kraft pulping. Initial results, 2004, C. R. Biologies 327 (2004) 817-826 (Year: 2004).*
Chiang and Funaoka (1990), The dissolution and condensation reactions of guaiacyl and syringyl units in residual lignin during kraft delignification of sweetgum (Abstract), *Holzforschzmg* 44(2):147-155, ISSN: 0018-3830.
Gierer and Petterson (1976), Studies on the condensation of lignins in alkaline media. Part II. The formation of stilbene and arylcoumatan structures through neighboring group participation reactions, *Can. J. Chem*. 55:593-599.
Gullichsen et al., (2000) "Chemical Pulping. Papermaking Science and Technology. 6A." Finland: Fapet Oy. pp. 291-292. ISBN 952-5216-06-3.
Lai AND Funaoka (1993), The Distribution of Phenolic Hydroxyl Groups in hardwood Lignins, *Wood Chem. Technol*. 1 3(1):43-57)
Sjödahl, EK and Lindström (2007), The influence of Industrial Black Liquor on the Delignification Rate in Kraft Cooking, J. *Pulp Paper Sci*. 33(4):240-245.).
T 227 om-99 Freeness of Pulp (Canadian standard method) (© 1999, Technical Association of Pulp and Paper Industry (TAPPI), Peachtree, Georgia.
Office Action in connection with Japanese Patent application No. 2020-522724, dated Oct. 5, 2021, from the Japanese Patent Office.

* cited by examiner

PHENOLS AS ADDITIVES IN KRAFT PULPING

CROSS-REFERENCE TO RELATED APPLICATIONS

Priority is hereby claimed to provisional patent application Ser. No. 62/573,510, filed Oct. 17, 2017, which is incorporated herein by reference.

BACKGROUND

Lignin condensation reactions yield stable lignin products having higher molecular weights than native lignin and which are more unreactive. These lignin condensation reactions are an unwanted side reaction during the kraft pulping process. The formation of these unwanted, unreactive lignins is a major obstacle to efficient delignification in kraft pulping.

A major drawback of the kraft pulping process is the relatively high residual lignin content of the resulting pulps. This residual lignin cannot, in industrial practice, be removed during pulping operations without causing severe losses in pulp yield and quality. Additionally, the residual lignin can only be partially removed during the oxygen delignification stage. Complete removal of the residual lignin requires using bleaching agents such as chloride dioxide and hydrogen peroxide.

Over the last 50 years, tremendous efforts have been devoted to a better understanding of the difficulty of eliminating residual lignin in kraft pulps. Three factors have frequently been demonstrated as reasons for the observed resistance of residual lignin to full removal during kraft pulping: 1) the formation of alkali stable lignin-carbohydrate linkages; 2) the progressive degradation of arylglycerol-beta-aryl ethers during kraft pulping; and 3) the occurrence of lignin condensation reactions, which give rise to the formation of lignin fractions with higher molecular weight and unreactive bonds.

The occurrence of lignin condensation reactions during kraft pulping was postulated in the 1970's. Gierer et al showed that, using model compounds, condensation reactions proceeded easily under the conditions prevailing in kraft pulping. (Gierer and Petterson (1976) *Can. J. Chem.* 55:593-599.) Chiang and Funaoka reported that more than 55% of the phenyl units present in softwood kraft pulps belong to condensed phenolic units, using the combined nitrobenzene oxidation and phenyl nucleus exchange techniques. (Chiang and Funaoka (1990) *Holzforschung* 44(2): 147-155.)

Lignin is a complex phenolic polymer arising from an enzyme-initiated dehydrogenation polymerization of three primary precursors: trans-coniferyl alcohol (1), trans-sinapyl alcohol (2), and trans-p-coumaryl alcohol (3). Softwood lignin is derived principally from coniferyl alcohol 3 while hardwood lignin comprises almost equal ratios of guaiacyl and syringyl hydroxyphenyl units with very little p-hydroxyphenol units. Grass lignin contains guaiacyl and syringyl units in varying ratios with significantly higher amounts of p-hydroxyphenyl units.

(1)

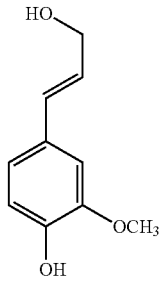

Coniferyl alcohol (2)

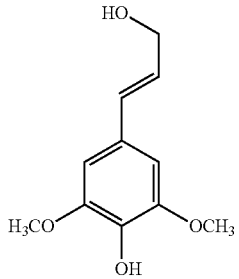

Sinapyl alcohol (3)

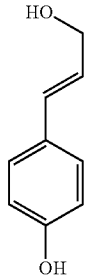

p-coumaryl alcohol

Coniferyl alcohol is unsubstituted at the C5 position. Lignin condensation reactions at this position give rise to the formation of C5 condensed phenolic units. Such a reaction has been proposed as the main condensation reaction occurring during kraft pulping (Lai and Funaoka (1993) *Wood Chem. Technol.*1 3(1):43-57)]. Radical coupling reactions between residual lignin in pulp and dissolved lignin fragments present in the pulping liquor has also been postulated to be a major pathway [Sjödahl, Ek and Lindström (2007) J. *Pulp Paper Sci.* 33(4):240-245.)]. Scheme 1 shows the predominant C5 substituent patterns for softwood lignin phenolic units:

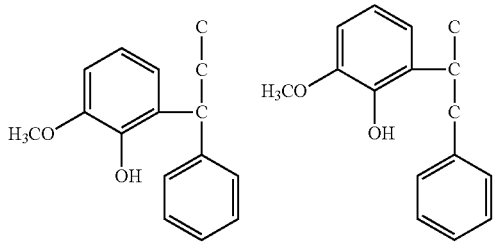

Cα—C5 Cβ—C5

-continued

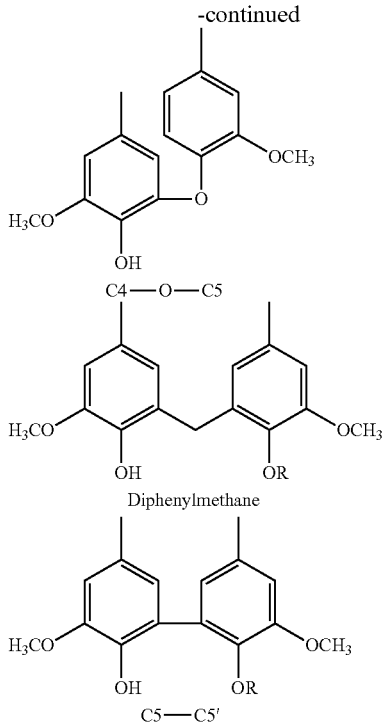

Scheme 1: Predominant C5 substitution patterns for softwood lignin phenolic units.

Although the occurrence of lignin condensation reactions has frequently been cited as the most probable reason for the difficulty of eliminating residual lignin in kraft pulps, little effort has been made to develop strategies that can minimize these unwanted side reactions. Thus, there remains a long-felt and unmet need to improve the kraft pulping process so that it yields pulp having a much lower residue lignin content without significantly increasing the cost, or decreasing the yield, of the kraft process itself.

SUMMARY

It is one object of the present invention to provide an improved kraft pulping process that yields increased delignification of the pulp during the cooking/digesting stage of the conventional kraft process.

In a typical implementation of the present method, the object is accomplished by adding one or more phenolic compounds, as that term is defined herein, during the cooking stage of the kraft pulping process. After the cooking stage, the resulting pulp may be further processed in ways conventional in the pulping industry.

Thus, in accordance with the method, the kraft pulping performance is improved, compared to the performance obtained with conventional kraft pulping process. The improved delignification yielded by the present method is shown via a decrease in Kappa number, which is an indicator of the lignin content in pulp, via an increase in pulp yield, or via both. The method may be used at reduced H-factor values to reach the desired target Kappa number or yield, or to increase pulp properties, or both.

Thus, disclosed herein is a method of kraft pulping comprising, in a kraft pulping reaction having a cooking step, adding a phenolic compound to the cooking step.

The phenolic compound is preferably selected from the group consisting of

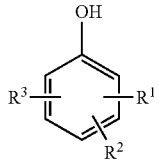

wherein $R^1$, $R^2$, and $R^3$ may be linked at any of positions 2, 3, 4, 5, or 6 relative to the hydroxyl, and are independently selected from the group consisting of hydrogen, hydroxyl, $C_1$-$C_{12}$-linear or branched alkyl, alkenyl, or akynyl, $C_1$-$C_{12}$-linear or branched alkoxy, $C_1$-$C_{12}$-linear or branched alkylhydroxyl, $C_1$-$C_{12}$-linear or branched alkanal, $C_1$-$C_{12}$-linear or branched alkylcarbonyl, $C_1$-$C_{12}$-linear or branched alkoxycarbonyl; $C_1$-$C_{12}$-linear or branched alkylthiol, $C_1$-$C_{12}$-linear or branched alkylthione, $C_1$-$C_{12}$-linear or branched alkylsulfide, $C_1$-$C_{12}$-linear or branched alkylsulfoxide, $C_1$-$C_{12}$ branched alkylsulfone, amino, and mono- or di-$C_1$-$C_{12}$-linear or branched alkylamino.

In all versions, the method may be practiced with phenolic compounds in which one (1), two (2), or all three (3) of $R^1$, $R^2$, or $R^3$ is/are not hydrogen.

The method may also be practiced with phenolic compounds in which $R^1$, $R^2$, and $R^3$ are independently selected from the group consisting of hydrogen, $C_1$-$C_6$-linear or branched alkyl, alkenyl, or akynyl, and $C_1$-$C_6$-linear or branched alkoxy, provided that at least one (1) of $R^1$, $R^2$, or $R^3$ is not hydrogen, or at least two (2) of $R^1$, $R^2$, or $R^3$ are not hydrogen, or all three (3) of $R^1$, $R^2$, or $R^3$ are not hydrogen.

The method may be practiced using a xylenol as the phenolic compound.

In all versions of the method, the method comprises adding the phenolic compound any time during the cooking step. Preferably, the phenols are added between 5-120 minutes prior to completion of the cooking step In all versions of the method, it is preferred, but not required, that the phenolic compound is added to the cooking step in an amount of from about 0.01 wt % to about 20 wt % based on the oven-dried weight of lignocellulosic material being subjected to the kraft pulping reaction. Concentrations of the phenolic compound above and below this range is explicitly within the scope of the claimed method.

DETAILED DESCRIPTION

Abbreviations and Definitions

Figure 1:
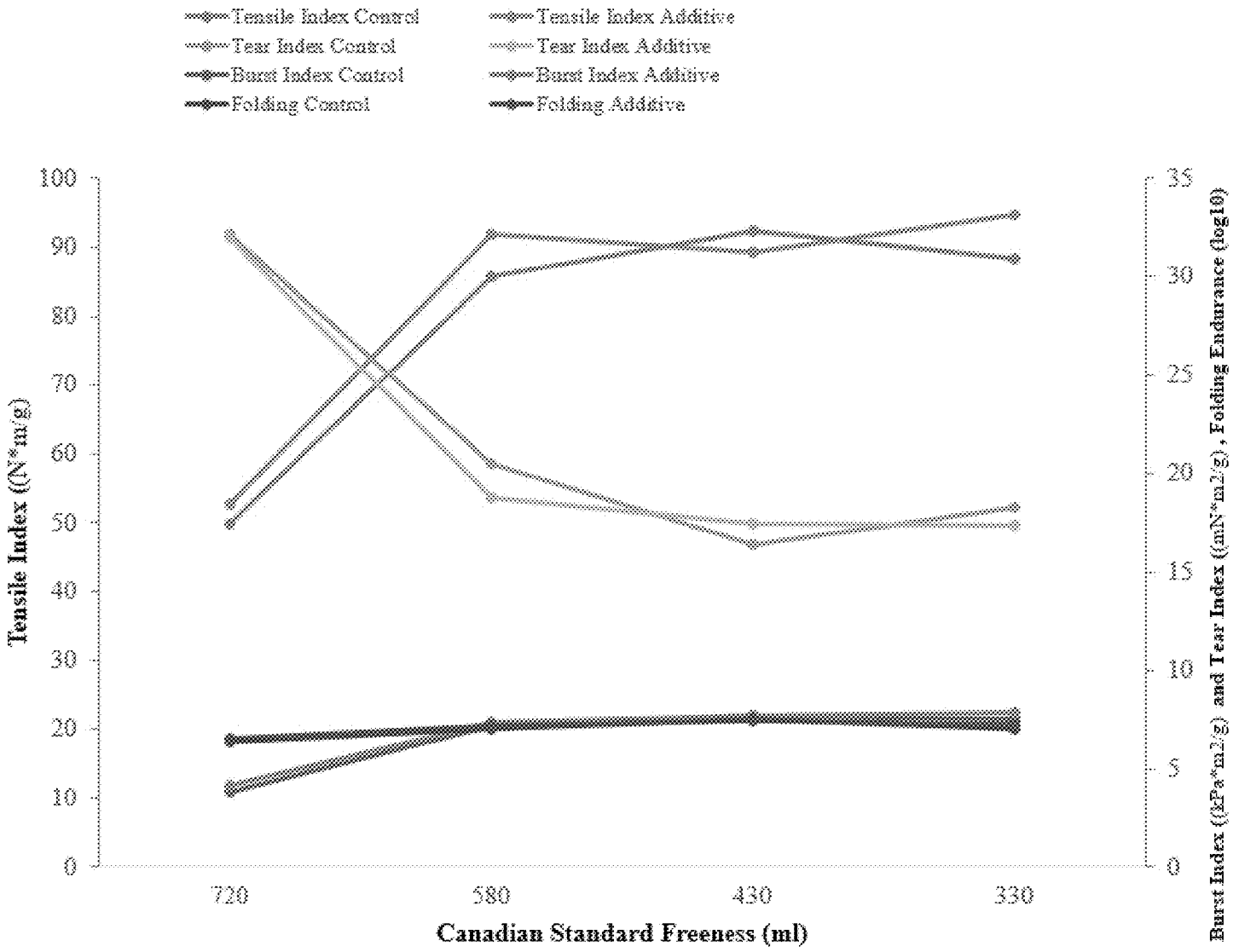
FIG. 1 is a graph comparing pulp strength properties with and without adding 2,4-xylenol as an additive during the cooking stage of the kraft pulping process.

"Kraft pulping" and "the kraft process" are used synonymously herein and refer to the conventional batch or continuous kraft pulping process and its known modifications. The phrase "sulphate pulping" is also synonymous. The kraft pulping process is exceedingly well-known among those skilled in the art of pulping and paper-making and has been used continuously on an industrial scale, world-wide, since the 1890's. It will not be described in any great detail herein. See U.S. Pat. No. 296,935, issued Apr. 15, 1884, to C. F. Dahl, which describes the basic process. U.S. Pat. No. 2,070,632, issued Feb. 16, 1937, to George H. Tomlinson, discloses the use of a recovery boiler, which enables the inorganic chemicals used in a pulp mill to be recovered and recycled. Kraft pulping is a multi-step process in which wood chips, saw dust, or any lignocellulosic material is treated/digested with an aqueous solution of sodium hydroxide (NaOH), and sodium sulfide ($Na_2S$), known as white liquor. The white liquor breaks the bonds that link lignin, hemicellulose, and cellulose. The predominant mechanism underlying the kraft process is the cleavage of ether bonds by nucleophilic sulfide ($S^{2-}$) or bisulfide ($HS^-$) ions. For a full description of the kraft process, see, for example, Mimms et al. (eds.) "Kraft Pulping," © 1997 Technical Association of Pulp and Paper Industry (TAPPI), Peachtree, Ga., ISBN 978-0898523225.

Broadly, the kraft process proceeds via the following steps in principle:

Impregnation: The lignocellulosic raw material is wetted and preheated with steam and then saturated with white liquor (a highly alkaline solution comprising sodium hydroxide and sodium sulfide).

Cooking: The wetted and pre-saturated material is then cooked (or "digested") for several hours at about 170° C. to 176° C. (338° F. to 349° F.) in a sealed, high-pressure reactor. The vast majority of lignin in the raw material is broken down and solubilized, while the cellulose fraction remains solid. The pulp is separated from the steeping liquor (which is now referred to as black liquor). After cooking, the pulp is referred to as brown stock because of its color.

Recovery process: The black liquor is recovered, concentrated, and the process chemicals (principally sodium hydroxide and sodium sulfide) are recovered and re-used.

The recovery step completes the basic kraft process. In practice, though, most modern pulping mills incorporate several additional, post-pulping steps, including:

Blowing: The finished pulp is blown to a collection tank at atmospheric pressure. The resulting drop in pressure releases steam and volatiles from the pulp. The volatiles are conventionally condensed and collected (as raw turpentine for further processing).

Screening: The pulp is screened to remove any remaining impurities, such as shives, knots, dirt, etc.

Washing: The brownstock pulp is typically then washed multiple times to remove any remaining process chemicals. In addition to the sodium hydroxide and sodium sulfide, modern kraft pulping typically uses any number of additional process chemicals to improve the efficiency of the process. These may include surfactants to improve impregnation of the wood chips with the cooking liquors, anthraquinone as a redox catalyst, emulsion breakers, flocculants, defoamers, dispersing agents, cleaning agents, and the like.

If a brighter, highly delignified pulp is required, a post-kraft pulping bleaching step is also used to whiten the pulp and further degrade any residual lignin remaining in the pulp. Bleaching, though, reduces the yield of cellulose and adds to the cost of producing the pulp.

"Canadian Standard Freeness" is a standardized analytic test to determine the rate at which a dilute specimen of pulp (3 g of pulp in 1 L of water) may be drained. See T 227 om-99 (© 1999, Technical Association of Pulp and Paper Industry (TAPPI), Peachtree, Ga.). Automated instruments for measuring Canadian standard freeness are available from several manufacturers, including Thwing-Albert Instrument Company, West Berlin, N.J., USA.

"H-Factor" refers to a widely used kinetic model for measuring the rate of delignification in kraft pulping. It is a single variable model combining temperature (T, in Kelvin) and time (t, in minutes) and assumes that delignification is a single-step reaction:

$$H=\int_0^t \exp(43.2-16115/T)dt$$

See, for example, Gullichsen, Johan; Fogelholm, Carl-Johan (2000) "Chemical Pulping. Papermaking Science and Technology. 6A." Finland: Fapet Oy. pp. 291-292. ISBN 952-5216-06-3. In short, the relationship between the time and the temperature in the cooking stage of kraft pulping is designated the H-factor. Thus, for example, if scheduling or production requires that a batch of lignocellulosic material be pulped faster, the H-factor equation is used to determine the increase in the temperature of the cooking stage required to pulp the material within the desired (reduced) time frame. Going in the other direction, if the pulping mill does not have an adequate supply of steam to heat a batch of material to a desired elevated temperature, the H-factor equation is used to determine the additional time needed to cook the batch at the reduced temperature that can be achieved using the available steam supply.

"Kappa number" is a unitless measure of lignin concentration in pulp. It is a standard analytic method codified in ISO 302:2015. A smaller Kappa number indicates less lignin in the pulp. (Thus, smaller Kappa numbers are desirable.) Automated Kappa number analyzers are commercially available from several manufacturers, including Skalar Analytical B.V. (Breda, The Netherlands), BTG Eclépens S.A (Eclépens, Switzerland), and Mantech, Inc. (Guelph, Ontario, Canada).

"Lignocellulosic materials" refers broadly to plant matter comprising lignocellulose, without limitation. The lignocellulosic materials to be used in the present method may be derived from wood, woody plant material, grasses, and/or non-wood-derived lignocellulosic material, without limitation. This material may be size-reduced and/or pre-treated with other known pre-treatment or extraction methods prior to being pulped according to the subject method.

The lignocellulosic pulp obtained after pulping according to the present method may be further delignified and/or bleached via conventional methods.

"Phenolic compound" as used herein refers to compounds having the following structure:

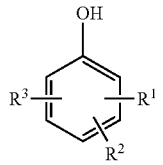

wherein $R^1$, $R^2$, and $R^3$ may be linked at any of positions 2, 3, 4, 5, or 6 relative to the hydroxyl, and are independently selected from the group consisting of hydrogen, hydroxy., $C_1$-$C_{12}$-linear or branched alkyl, alkenyl, or akynyl, $C_1$-$C_{12}$-linear or branched alkoxy, $C_1$-$C_{12}$-linear or branched alkylhydroxyl, $C_1$-$C_{12}$-linear or branched alkanal, $C_1$-$C_{12}$-linear or branched alkylcarbonyl, $C_1$-$C_{12}$-linear or branched alkoxycarbonyl; $C_1$-$C_{12}$-linear or branched alkylthiol, $C_1$-$C_{12}$-linear or branched alkylthione, $C_1$-$C_{12}$-linear or branched alkylsulfide, $C_1$-$C_{12}$-linear or branched alkylsulfoxide, $C_1$-$C_{12}$ branched alkylsulfone, amino, and mono- or di-$_1$-$C_{12}$-linear or branched alkylamino.

"Alkyl" means a linear, branch, or cyclic, fully saturated hydrocarbon moiety, for example methyl, ethyl, 1-propyl, 2-propyl, 1-butyl, 2-methyl-1-propyl, cyclopropyl, cyclobutyl, cyclopentyl, etc. "Alkenyl" refers to an alkyl group having one or more double bonds. "Akynyl" refers to an alkyl group having one or more triple bonds.

"Alkoxy" refers to O-linked and C-linked ether moieties, e.g., —O—$C_1$-$C_{12}$-alkyl, —$C_1$-$C_6$-alkyl-O—$C_1$-$C_6$-alkyl, etc.

"Alkanal" refers to $C_1$-$C_{12}$-linear or branched aldehyde, e.g., —$C_1$-$C_{12}$-alkyl-C(═O)H.

"Alkylcarbonyl" refers to a $C_1$-$C_{12}$-linear or branched ketone, for example, —$C_1$-$C_6$-alkyl-(═O)—$C_1$-$C_6$-alkyl, etc.

"Alkoxycarbonyl"; $C_1$-$C_{12}$-linear or branched carboxylic acid or ester, e.g., —$C_1$-$C_{12}$-alkyl-(═O)—H, —$C_1$-$C_6$-alkyl-(═O)—O—$C_1$-$C_6$-alkyl, and the like.

"Alkylthiol" means —$C_1$-$C_{12}$-alkyl-SH. The thiol group may be at a terminal or internal position.

"Alkylthione" means for example, —$C_1$-$C_6$—(═S)—$C_1$-$C_6$-alkyl, and the like.

"Alkylsulfide" means a sulfo-ether, for example, —S—$C_1$-$C_{12}$-alkyl, —$C_1$-$C_6$-alkyl-S—$C_1$-$C_6$-alkyl, etc.

"Alkylsulfoxide" means, for example, —$C_1$-$C_6$-alkyl-(S═O)—$C_1$-$C_6$-alkyl, and the like.

"Alkylsulfone" means, for example, —$C_1$-$C_6$-alkyl-(S(═O)$_2$)—$C_1$-$C_6$-alkyl, and the like.

It one version of the method, at least one of $R^1$, $R^2$ or $R^3$ is not hydrogen. Thus, for example, if $R^1$ is not hydrogen, the phenolic compound can be any of ortho (1,2)-, meta (1,3)-, and/or para (1,4)-mono-substituted phenol:

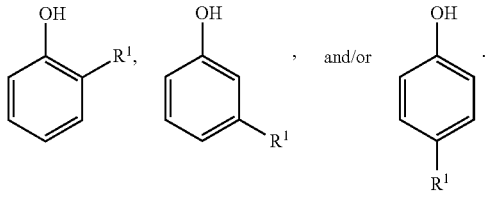

In another version of the method, at least two of $R^1$, $R^2$ or $R^3$ are not hydrogen. Thus, for example, if $R^1$ and $R^2$ are not hydrogen, the phenolic compound can be any of 2,6-, 2-5-, 2-4, 2,3-, 3,4- and/or 3,5-di-substituted phenol:

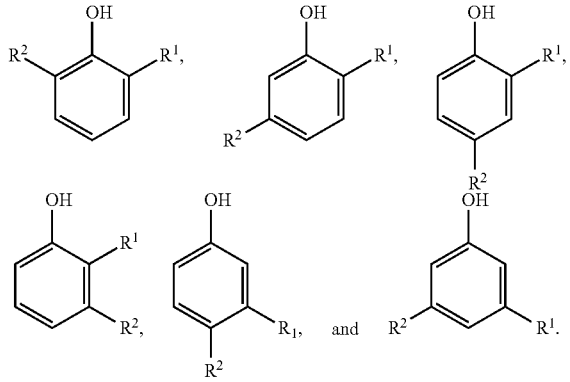

Thus, by way of example and not limitation, when two of $R^1$, $R^2$, or $R^3$ are hydrogen, and the remaining substituent is hydrogen, the phenolic compound can be any of 2,6-, 2-5-, 2-4, 2,3-, 3,4- and/or 3,5-xylenol.

Similarly, in yet another version of the method, all of $R^1$, $R^2$ or $R^3$ are not hydrogen. Here, the phenolic compound can be any of 2,3,4-, 2,3,5-, 2,3,6-, 2,4,5-, 2,4,6- and/or 3,4,5-tri-substituted phenol:

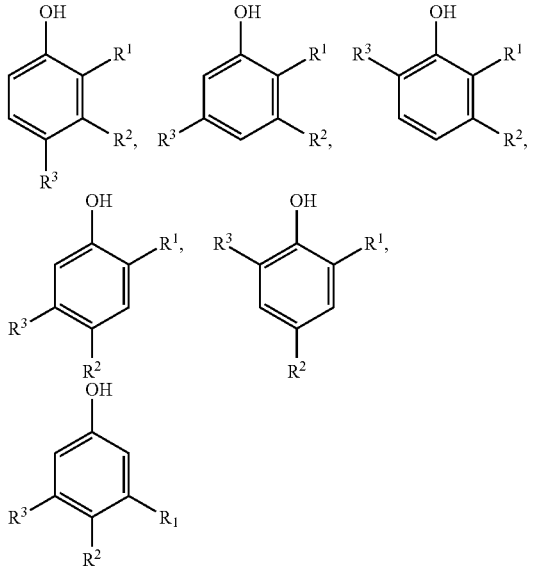

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 1 to 9, from 3.6 to 4.6, from 3.5 to 9.9, and so forth.

All references to singular characteristics or limitations of the present invention shall include the corresponding plural characteristic or limitation, and vice-versa, unless otherwise specified or clearly implied to the contrary by the context in which the reference is made. The indefinite articles "a" and "an" mean "one or more."

All combinations of method or process steps as used herein can be performed in any order, unless otherwise specified or clearly implied to the contrary by the context in which the referenced combination is made.

The methods of the present invention can comprise, consist of, or consist essentially of the essential elements and limitations of the method described herein, as well as any additional or optional ingredients, components, or limitations described herein or otherwise useful in organic chemistry generally and pulping and paper-making chemistry specifically.

The Method:

The method proceeds as does a conventional kraft pulping reaction. The lignocellulosic material to be pulped is placed into a sealable cooking vessel (also known as a batch digester or continuous digester). Conventional kraft cooking liquors are also added to the cooking vessel. Additionally, an amount of one or more phenolic compounds, as that term has been defined herein, is added to the cooking vessel. The amount of phenolic compound(s) added is sufficient to improve the delignification of the lignocellulosic material. The kraft pulping reaction then proceeds in conventional fashion. Alternatively, the phenolic compound (s) may be added to the digester vessel any time after the start of the cooking period and during the cooking period.

EXAMPLES

The following examples are included to provide a more complete description of the method disclosed and claimed herein. The examples do not limit the scope of the claimed method in any fashion.

Example 1

2,4-xylenol was added 15 minutes prior to the end of the cook with a set of cooking conditions as follows:

H-factor: 2375
White liquor-to-wood ratio: 6:1
Active alkali: 21% (as NaOH)
Sulfidity: 30% (as $Na_2S$)
Cooking temperature: 170° C.
Total cooking time: 157 minutes In this example, softwood chips from a mill were screened to a size between about 4 and about 8 mm. Oven dried chips (500 g) were loaded into a MK digester (Model M/K600-2; M/K Systems, Inc., North Adams, Mass.) and the digester was filled with the necessary amounts of NaOH and $Na_2S$. The contents were then heated by forced circulation of the cooking liquor through a heat exchange. When temperature reached 100° C., air and other non-condensable gases were relieved through a pressure control valve at the top of the vessel by opening the valve for 10 seconds. The contents were then heated to reach the cooking temperature of 170° C.

For cooking using 2,4-xylenol, the 2,4-xylenol was injected into the circulation loops of the cooking liquor 15 minutes prior to the end of the cook under otherwise identical conditions. The pH of 2,4-xylenol was adjusted to 12.5 before it was injected into the digester vessel. This was to compensate for alkaline consumption due to the ionization of the hydroxyl groups in the 2,4-xylenol.

The amount of 2,4-xylenol added was 0.75 wt % based on the oven-dried weight of the lignocellulosic materials.

As a control, three identical batches were cooked without adding 2,4-xylenol under the same process conditions. The Kappa numbers, accept yields, and reject yields for each batch was determined. The average Kappa number, accept yield, and reject yield for the three batches was:

Kappa number: 32.2
Accept yield: 42.3%
Reject percent: 0.10%

For the test, two identical batches were cooked using added 2,4-xylenol in the amount noted above, under the same process conditions. Data on the two runs were averaged and found to be:

Kappa number: 27.7
Accept yield: 42.1%
Reject yield: 0.245%

It is readily evident therefore that the Kappa number of the pulp was lower when 2,4-xylenol was used (27.7 vs 32.2), thus demonstrating showing that the performance of the kraft pulping was significantly improved.

Example 2

In this example, the test runs were performed under otherwise identical conditions as listed for Example 1, except 2,4-xylenol was added halfway through the cooking cycle. Again, two test runs with added 2,4-xylenol were conducted. The average of Kappa number, accept yield and reject yield were as follows:

Kappa number: 26.7
Accept yield: 41.9%
Reject percent: 0.07%

It is readily evident therefore that the Kappa number of the pulp was lower when 2,4-xylenol was used as compared to that obtained without using 2,4-xylenol. These results clearly demonstrate that adding the phenolic compound during the cooking stage, after the digestion has reached full temperature and has passed through half of the cooking time, significantly improved the results of kraft pulping.

Example 3

In this example, the test runs were performed under otherwise identical conditions as listed in the Example 2, except the amount of 2,4-xylenol added was 0.375 wt % based on the oven-dried weight of the lignocellulosic materials. The average Kappa number, accept yield, and reject yield for the two test runs were as follows:

Kappa number: 28.9
Accept yield: 42.8%
Reject percent: 0.06%

It is readily evident therefore that the Kappa number of the pulp was lower and accept yield was higher when 2,4-xylenol was used, as compared to the corresponding yields obtained without using 2,4-xylenol as listed in the example 1. This example shows that the performance of the kraft pulping was improved by adding a phenolic compound to the cooking stage.

Example 4

The effect of adding phenolic compounds in achieving accelerated and selective delignification was also demonstrated by the results obtained from cooking the lignocellulosic batch at a low H-factor (2150) and adding 0.75 wt % 2,4-xylenol (based on the oven-dried mass of lignocellulosic starting material. In all other respects, this example was the same as Example 1. Here, the accept yield was 43.2%. The H-factor in this example, though, was 225 lower than that of the control cook, but it produced a pulp with a lower Kappa number.

Figure 2:
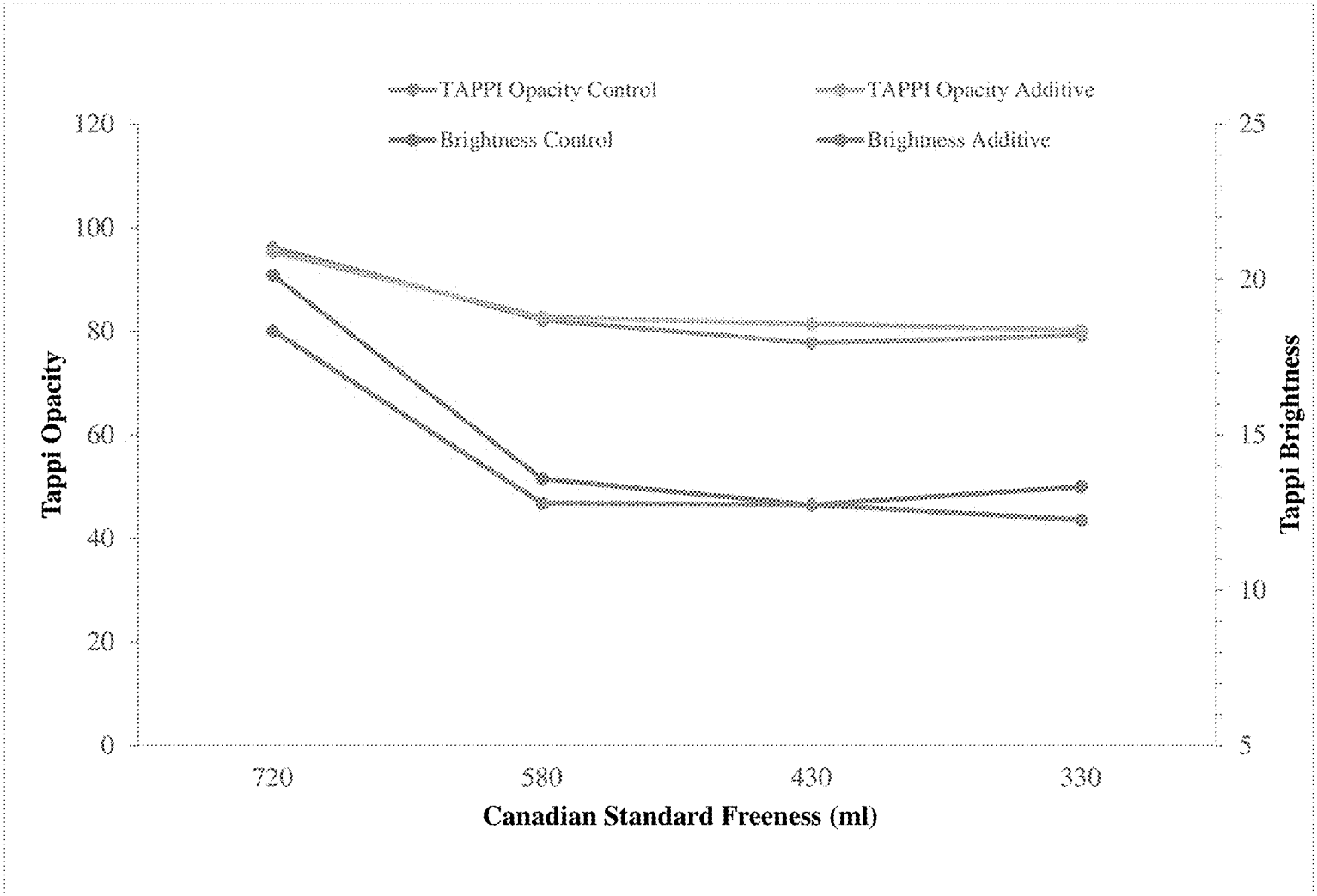
FIG. 2 is a graph comparing pulp optical properties with and without adding 2,4-xylenol as an additive during the cooking stage of the kraft pulping process.

All pulp optical (brightness and opacity) and strength properties (tensile, tear, burst and folding) obtained at H-2375 with and without using the additive at a change of 0.75 wt % were found to be similar. See FIGS. 1 and 2. FIG. 1 is a graph comparing pulp strength properties with and without adding 2,4-xylenol as an additive during the cooking stage of the kraft pulping process. The left-hand Y-axis shows tensile index (N*m/g), the X-axis shows Canadian standard freeness (mL), the right-hand Y-axis shows burst index (kPa*$m^2$/g), tear index (mN*$m^2$/g), and folding endurance (log 10). As can be seen in FIG. 1, all of these metrics are very similar in the controls and test samples FIG. 2 is a graph comparing pulp optical properties with and without adding 2,4-xylenol as an additive during the cooking stage of the kraft pulping process. The left-hand Y-axis shows TAPPI Opacity, the right-hand Y-axis shows TAPPI brightness, the X-axis shows Canadian standard freeness. The controls and test samples exhibited very similar results.

All of the control samples and the test samples treated with xylenol had similar Canadian standard freeness (CSF). See FIGS. 1 and 2, X-axis.

What is claimed is:

1. A method of kraft pulping comprising: in a kraft pulping reaction having an impregnation step and a separate cooking step that takes place after the impregnation step, adding an additional phenolic compound to the pulping reaction during the cooking step and at a time point after the start of the cooking step and between about 5 minutes and about 120 minutes prior to completion of the cooking step, wherein the phenolic compound is added to the cooking step in an amount of from about 0.75 wt % to about 0.375 wt % based on oven-dried weight of lignocellulosic material being subjected to the kraft pulping reaction;

wherein the phenolic compound is selected from the group consisting of

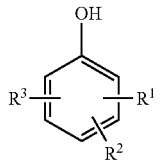

wherein $R^1$, $R^2$, and $R^3$ are independently selected from the group consisting of, $C_1$-$C_6$-linear or branched alkyl, alkenyl, or akynyl, and $C_1$-$C_6$-linear or branched alkoxy.

2. The method of claim 1, comprising adding the phenolic compound at a time point not later than about 15 minutes prior to completion of the cooking step.

3. A method of kraft pulping comprising: in a kraft pulping reaction having an impregnation step and a separate cooking step that takes place after the impregnation step, adding xylenol to the pulping reaction during the cooking step and at a time point after the start of the cooking step and between about 5 minutes and about 120 minutes prior to completion of the cooking step, wherein the xylenol is added to the cooking step in an amount of from about 0.75 wt % to about 0.375 wt % based on oven-dried weight of lignocellulosic material being subjected to the kraft pulping reaction.

4. The method of claim 3, comprising adding the xylenol at a time point not later than about 15 minutes prior to completion of the cooking step.

* * * * *